US005397069A

United States Patent [19]

Kitsukawa et al.

[11] Patent Number: 5,397,069

[45] Date of Patent: Mar. 14, 1995

[54] JAW CRUSHER FOR NON-RIGID OBJECT SUCH AS ASPHALT

[75] Inventors: Tomohiro Kitsukawa; Koichiro Ogushi, both of Takeo, Japan

[73] Assignee: Nakayama Iron Works, Ltd., Takeo, Japan

[21] Appl. No.: 197,887

[22] Filed: Feb. 17, 1994

[30] Foreign Application Priority Data

Aug. 31, 1993 [JP] Japan ..... 5-237182

[51] Int. Cl.[6] ..... B02C 1/04; B02C 1/10

[52] U.S. Cl. ..... 241/267

[58] Field of Search ..... 241/264, 267, 268, 269

[56] References Cited

U.S. PATENT DOCUMENTS

| | | | |
|---|---|---|---|
| 3,946,955 | 3/1976 | Bond | 241/264 |
| 3,984,058 | 10/1976 | Archer et al. | 241/264 |
| 4,361,289 | 11/1982 | Georget et al. | 241/264 X |
| 4,783,013 | 11/1988 | Polzin | 241/264 X |
| 5,172,869 | 12/1992 | Kitsukawa et al. | 241/264 |

*Primary Examiner*—Timothy V. Eley

*Attorney, Agent, or Firm*—Armstrong, Westerman, Hattori, McLeland & Naughton

[57] ABSTRACT

A jaw crusher designed to break a non-rigid object, e.g., asphalt, into pieces of desired size without causing the object to be undesirably mashed by changing the motion of a movable tooth plate relative to a fixed tooth plate. The jaw crusher includes a fixed tooth plate (16), a swing jaw (8), a movable tooth plate (15), and a toggle plate (10). Motion of a lower end portion of the movable tooth plate (15) which is on an approximately circular locus satisfies the conditions that the relative angle between a straight line connecting the lower and upper end points of the approximately circular locus and the fixed tooth plate (16) is not smaller than 20°, and that the distance between the lower and upper end points is not shorter than 50 mm.

1 Claim, 5 Drawing Sheets

JAW CRUSHER FOR NON-RIGID OBJECT SUCH AS ASPHALT

BACKGROUND OF THE INVENTION

1. Field of the Invention

The present invention relates to a jaw crusher for breaking a non-rigid object like asphalt. More particularly, the present invention relates to a jaw crusher suitable for breaking a viscous, non-rigid object, e.g., asphalt pavement wastes.

2. Description of the Background Art

Jaw crushers are known and used as machines for breaking rocks, asphalt pavement wastes, concrete scraps, etc. into pieces of desired size. These days, a large amount of concrete scrap and asphalt pavement waste are produced by dismantling of concrete buildings, repair of asphalt pavements, etc. Treatment of these wastes, particularly in urban areas, gives rise to a social problem because of the generation of noise and dust during the treatment, difficulty in securing a place for dumping wastes, a high cost of waste transportation, etc. For this reason, these wastes are desired to be speedily treated and reused at or near the site where the wastes are produced, as much as possible.

It will be advantageous if asphalt pavement wastes can be broken into pieces which are sufficiently small in particle size to be reused as aggregates or other similar material by using a conventional jaw crusher capable of efficiently breaking a rigid object, e.g., rocks, into pieces of desired size. However, if a conventional jaw crusher, which has been developed to break rocks or other rigid objects since the beginning of the development thereof, is used for breaking asphalt pavement wastes as it is, the asphalt pavement wastes may be undesirably mashed or stick to the movable and fixed tooth plates and fail to drop from the V-shaped crushing space defined between the two tooth plates. Thus, the conventional jaw crusher becomes unable to break the object of crushing. Moreover, it is almost impossible for the conventional machine to crush asphalt pavement wastes favorably for reuse of them. At present, conventional jaw crushers are reluctantly used as they are for breaking asphalt pavement wastes, and reuse of asphalt pavement wastes is not considered.

Incidentally, jaw crushers for breaking rocks include various types which may be most suitably selected for each particular use in conformity to the kind of rock to be crushed and the particle size of pieces into which rocks are to be broken. We carried out an experiment by breaking asphalt pavement wastes with these various types of conventional jaw crusher, and found a new way of improving the conventional jaw crushers for effectively breaking asphalt pavement wastes.

SUMMARY OF THE INVENTION

The present invention has been accomplished on the basis of the above-described technical background, and aims at attaining the following object.

It is an object of the present invention to provide a jaw crusher for breaking a non-rigid object like asphalt, which is designed to break asphalt or other non-rigid object into pieces of desired size without causing the object to be undesirably mashed or stick to the movable and fixed tooth plates by changing the motion of the movable tooth plate relative to the fixed tooth plate.

To attain the above-described object, the present invention provides a jaw crusher for breaking a non-rigid object, e.g., asphalt. The jaw crusher has a body (1), and a fixed tooth plate (16) is secured to the body (1). A swing jaw (8) swings relative to the fixed tooth plate (16). A movable tooth plate (15) is secured to the swing jaw (8) at an acute angle to the fixed tooth plate (16) to define a crushing space for breaking an object of crushing between the movable tooth plate (15) and the fixed tooth plate (16). An eccentric rotating shaft (7) is provided on the body (1) to swingably support the upper end portion of the swing jaw (8) and to rotate eccentrically. A swing support member (10) is provided between the body (1) and the swing jaw (8) so as to be swingable relative to both the body (1) and the swing jaw (8). Motion of the lower end portion of the movable tooth plate (15) which is on an approximately circular locus satisfies the following conditions (U1) and (U2):

(U1) the relative angle between a straight line connecting the lower and upper end points of the approximately circular locus and the fixed tooth plate (16) is not smaller than 20°; and (U2) the distance between the lower and upper end points is not shorter than 50 mm.

In the jaw crusher for breaking a non-rigid object, e.g., asphalt, according to the present invention, the lower end portion of the movable tooth plate (15) moves on a circular locus. The motion takes place in approximately straight line from the lower end point to the upper end point of the circular locus. The angle of the straight-line locus relative to the fixed tooth plate (16) is not smaller than 20°. In addition, the stroke of this motion is not smaller than 50 mm. By virtue of such motion, an object of crushing is strongly held and pressed between the two tooth plates, and in this state, it is subjected to shearing force. Thus, the object is broken into particles of desired size without being mashed. Accordingly, there is no likelihood that the object of crushing will stick to the two tooth plates, causing the machine to fall into a failure of crushing operation.

BRIEF DESCRIPTION OF THE DRAWINGS

The above and other objects, features and advantages of the present invention will become more apparent from the following description of the preferred embodiment thereof, taken in conjunction with the accompanying drawings, in which like reference numerals denote like elements, and of which.

DETAILED DESCRIPTION OF THE EMBODIMENT

One embodiment of the present invention will be described below with reference to the accompanying drawings.

Figure 1:
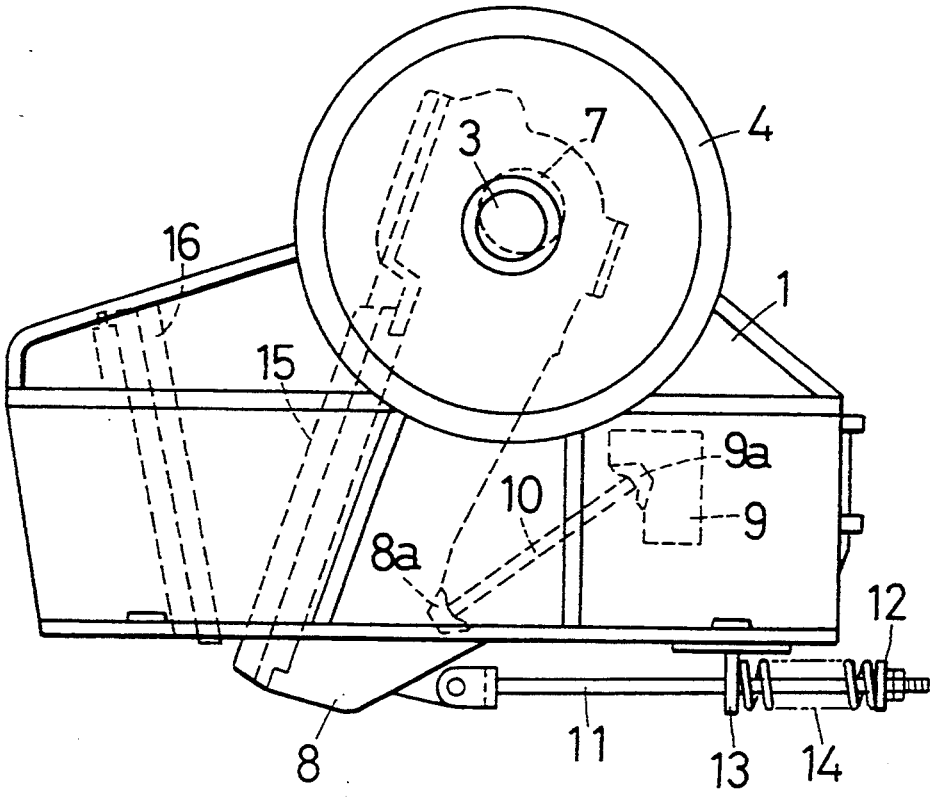
FIG. 1 is a front view of one embodiment of the jaw crusher according to the present invention.
Figure 2:
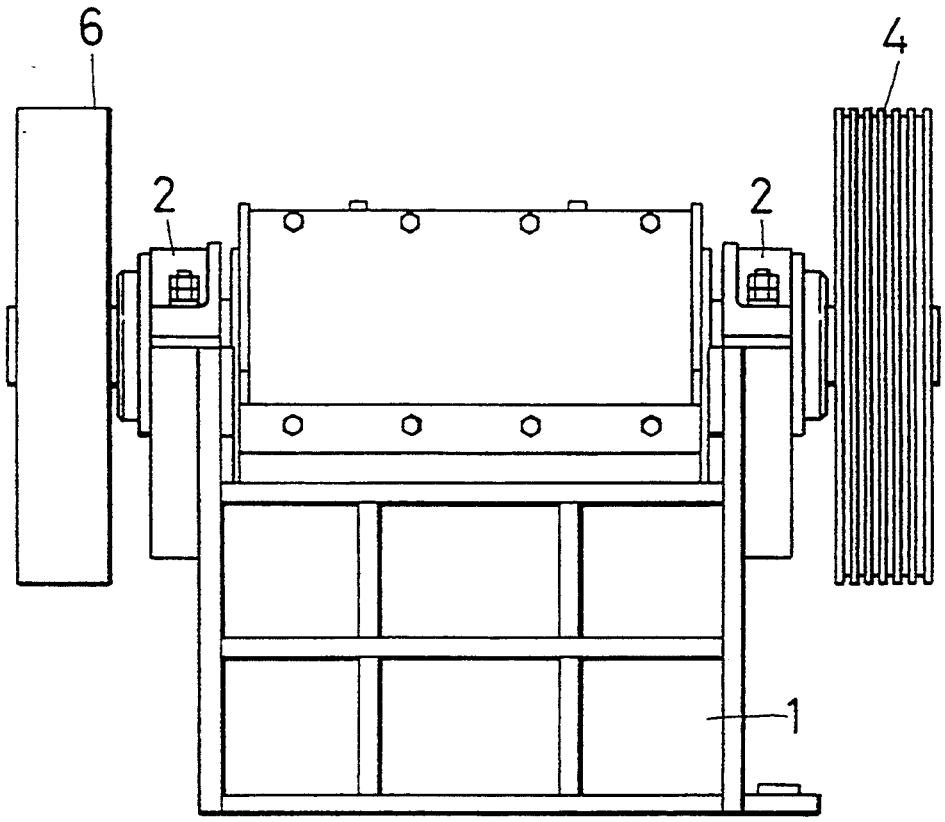
FIG. 2 is a plan view of the embodiment shown in FIG. 1.

FIGS. 1 and 2 show one embodiment of the jaw crusher for a non-rigid object, e.g., asphalt, according to the present invention. FIG. 1 is a front view, and FIG. 2 is a plan view. These figures show a crusher that is generally called "single-toggle type jaw crusher" (hereinafter referred to as "jaw crusher"). The jaw crusher has a body 1 that is made of steel plate. The body 1 is provided with two bearings 2. A driving shaft 3 is rotatably supported by the bearings 2. A pulley 4 for driving the shaft 3 is attached to one end of the shaft 3. The outer periphery of the pulley 4 is provided with a plurality of V-belt grooves 5. V-belts (not shown) are engaged between the V-belt grooves 5 of the pulley 4 on the one hand and a plurality of V-belt grooves on the other, which are provided on a pulley (not shown) attached to the output shaft of a driving motor (not shown).

A flywheel 6 is attached to the other end of the driving shaft 3. An eccentric rotating shaft 7 is eccentrically provided on a rotating member (not shown) which rotates together with the driving shaft 3 as one unit. The upper end portion of a swing jaw 8 is attached to and rotatably supported by the eccentric rotating shaft 7. The rear side (the right-hand side as viewed in FIG. 1) of the lower end portion of the swing jaw 8 is provided with a recess 8*a*. A plate retainer 9, which is secured to the body 1, is also provided with a recess 9*a*. A toggle plate 10 as a swing support member is stretched between the recess 8*a* of the swing jaw 8 and the recess 9*a* of the plate retainer 9.

A pulling rod 11 is rotatably attached to the lower end of the swing jaw 8. A compression coil spring 14 is provided between a collar 12 attached to the rear end of the pulling rod 11 and a spring retainer 13 which is secured to the body 1 so that the pulling rod 11 extends through the spring retainer 13.

A movable tooth plate 15 which is in the form of a flat plate is secured to the front side of the swing jaw 8. A fixed tooth plate 16 which is also in the form of a flat plate is secured to a slightly inclined wall surface inside the body 1 in opposing relation to the movable tooth plate 15. The fixed tooth plate 16 is set at an acute angle to the movable tooth plate 15 to define therebetween a crushing space with a V-shaped cross-sectional configuration for breaking an object of crushing.

The operation of the above-described embodiment will be explained below. The driving shaft 3 is driven to store energy in the flywheel 6. The swing jaw 8, which is supported by the toggle plate 10, performs swing motion under the control of the toggle plate 10. Since the swing jaw 8 is constantly pulled by the compression coil spring 14, the toggle plate 10 will not separate from the swing jaw 8 or the plate retainer 9. Accordingly, the point (approximately one point) of rolling contact between the toggle plate 10 and the recess 8*a* of the swing jaw 8 rotates about the point (approximately one point) of rolling contact between the toggle plate 10 and the recess 9*a* of the plate retainer 9.

Figure 3:
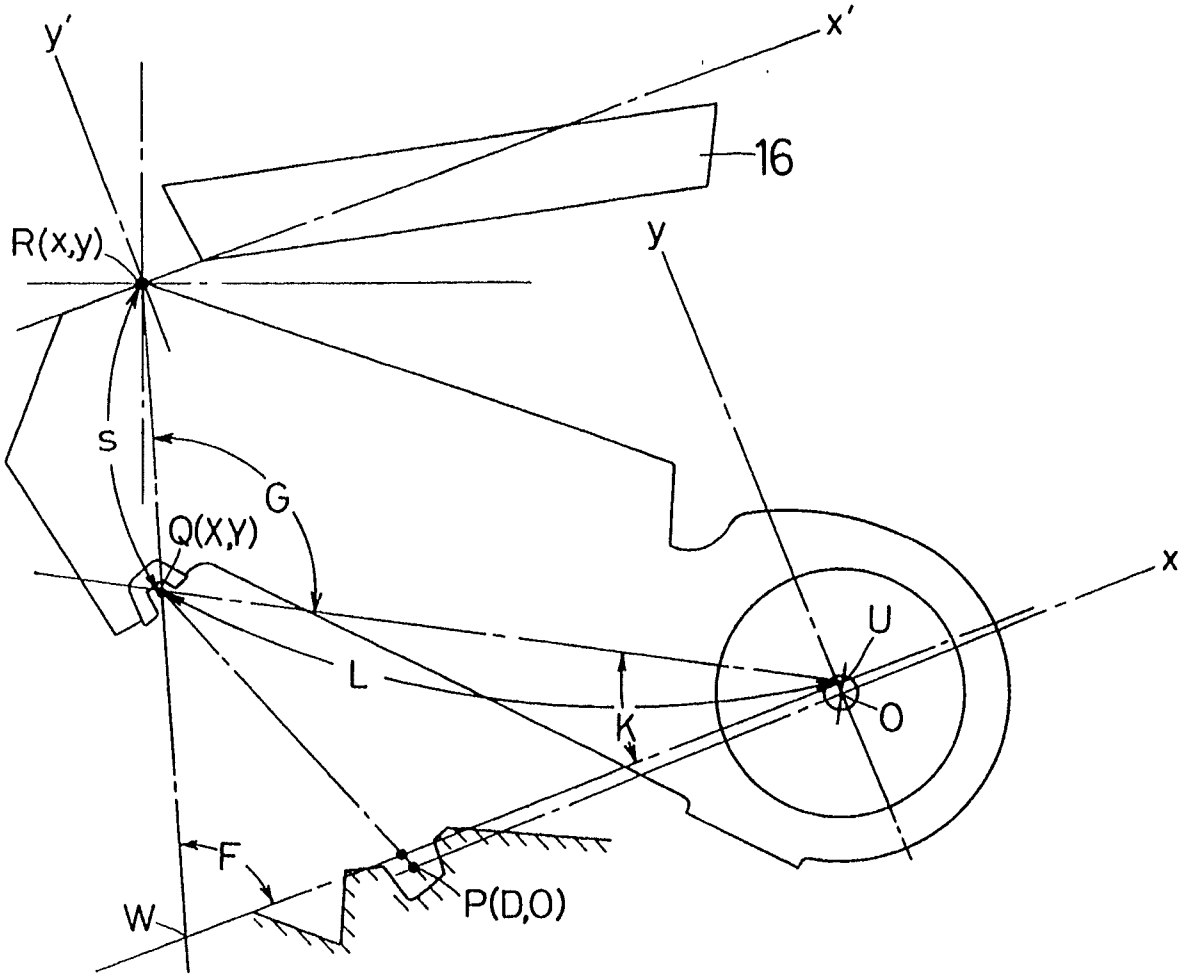
FIG. 3 shows an orthogonal coordinate system for explanation of the operation of the embodiment.

FIG. 3 shows an orthogonal coordinate system (x, y) for analysis of the motion of an end point on the movable tooth plate 15. The origin O represents the axis of the driving shaft 3, and the point P (D, 0) is the point of rolling contact between the toggle plate 10 and the recess 9*a* of the plate retainer 9. The point Q (x, Y) is the point of rolling contact between the toggle plate 10 and the recess 8*a* of the swing jaw 8, and the point R (x, y) is a specific end point on the movable tooth plate 15. The amount of eccentricity of a point U on the swing jaw 8 in the vicinity of the eccentric rotating shaft 7 is taken as a unit length, which is assumed to be 1 (e.g., 10 mm). The point U is on a circle with a radius 1 which is centered at the origin O as viewed in FIG. 1. Accordingly, the coordinates of the point U are determined by $$U(t, \pm\sqrt{1-t^2})$$

where t=cos(Z), and the angle Z is continuous in the range of from zero radian to 6.28 radian. Since the point Q is on a circle with radius R which is centered at the point P, the coordinates X, Y of the point Q satisfy the following equation (1):

$$(X+D)^2+Y^2=R^2 \tag{1}$$

Since both the points U and Q are fixed points on the swing jaw 8, the distance between the points U and Q is constant, which is represented by L. From the Pythagorean theorem (the theorem of three squares), the following equation (2) is obtained:

$$(-X+t)^2+(Y\pm\sqrt{1-t^2})^2=L^2 \tag{2}$$

Since both the points R and Q are fixed points on the swing jaw 8, the distance between the points R and Q is constant, which is represented by s. From the Pythagorean theorem, the following equation (3) is obtained:

$$(x-X)^2+(y-Y)^2=s^2 \tag{3}$$

Assuming that the angle of inclination of a straight line connecting the points R and Q is F, the inclination of the straight line RQ is tan(F). Since this straight line passes through the point R (x, y), the straight line RQ may be expressed by $$y-Y=\tan(F)\,(x-X) \tag{4}$$

Assuming that the angle UQR=G and the angle QUW=K (the point W is shown in FIG. 3), the following equation (5) is obtained:

$$F=G-K,\ \angle UQR=G,\ \angle QUW=K \tag{5}$$

If tan(F)=(sin(F))/(cos(F)) is calculated, the following equation (6) is obtained:

$$\tan(K)=-\frac{Y\pm\sqrt{1-t^2}}{t-X} \tag{6}$$

From equations (3) and (4), $$(x-X)^2+(1+\tan(F))^2=s^2 \tag{7}$$

From equation (7), $$x=X\pm\frac{S}{\sqrt{1+\tan^2(F)}} \tag{8-1}$$

$$y=Y\pm\tan(F)\frac{S}{\sqrt{1+\tan^2(F)}} \tag{8-2}$$

The coordinates (X, Y) may be obtained from equations (1) and (2) as follows:

$$X = A \cdot \frac{-AB \pm \sqrt{A^2B^2 - (1 + A^2)(B^2 - R^2)}}{(1 + A^2)} + B \quad (9\text{-}1)$$

$$Y = \frac{-AB \pm \sqrt{A^2B^2 - (1 + A^2)(B^2 - R^2)}}{(1 + A^2)} \quad (9\text{-}2)$$

where A and B are defined by the following equations (10-1) and (10-2):

$$A = \pm \frac{\sqrt{1 - t^2}}{t + D} \quad (10\text{-}1)$$

$$B = -\frac{D^2 + L^2 - R^2 - 1}{2(t + D)} \quad (10\text{-}2)$$

Since $\tan(F) = \tan(G - K) = \tan(G) - \tan(K)/(1 + \tan(G) \cdot \tan(K))$, tan(F) may be obtained from this relationship and equation (6) as follows:

$$\tan(F) = \frac{\tan(G) + (Y \pm \sqrt{1 - t^2})}{(t - X) - \tan(G)(Y \pm \sqrt{1 - t^2})} \quad (11)$$

If tan(F) thus obtained, together with X and Y which are obtained by substituting equations (10-1) and (10-2) into equations (9-1) and (9-2), is substituted into equations (8-1) and (8-2), the coordinates (x, y) of the end point R on the movable tooth plate 15 are represented by the angle G, the length R, the length L and the length s, which are constants, and the variable t. Thus, there is only one variable. Although the functional relation between x and y cannot readily be obtained, x and y are represented by the variable t(=cos(Z)) alone. Accordingly, the locus of motion of the end point R can roughly be observed by plotting (x, y) obtained by substituting values for Z which are obtained by dividing the angle range of from zero radian to 6.28 radian into, for example, 100 equal partitions (it should be noted that the ± signs in the above equations are not double signs in same order).

The locus of the point R in FIG. 3 is obtained under the conditions of G=105°, D=68.3, L=102.0, R=56.0, s=35.2, and the eccentricity is 10 mm. If the coordinate system (x, y) is translated to the point R to form a coordinate system (X', y') with the point R defined as origin and coordinates (X', y') are printed out with the above-described angle range divided into 10 equal partitions, the following values are obtained (only for ¼, i.e., 90°):

| x' | y' |
|---|---|
| 0 | 0 |
| 1.2 | 0.6 |
| 2.5 | 1.2 |
| 4.1 | 1.8 |
| 5.9 | 2.3 |
| 7.7 | 2.8 |
| 9.8 | 3.2 |
| 12.0 | 3.7 |
| 14.3 | 4.2 |
| 16.7 | 4.5 |
| 19.7 | 4.8 |

If the number of partitions is increased to observe the motion even more finely, it will be understood that the motion is relatively slow at both ends of the circular locus but relatively fast at the intermediate portion. Such a locus is approximately in the shape of a circular arc (see Japanese Patent Application Post-Exam. Publication No. 36-2641 (1961)). However, detailed observation reveals that the locus has hysteresis, that is, there is a difference in locus between the go and return strokes of the reciprocating motion, and that the locus has a shape intermediate between an elliptic shape and a crescent shape. The two end points are sharp.

Figure 4:
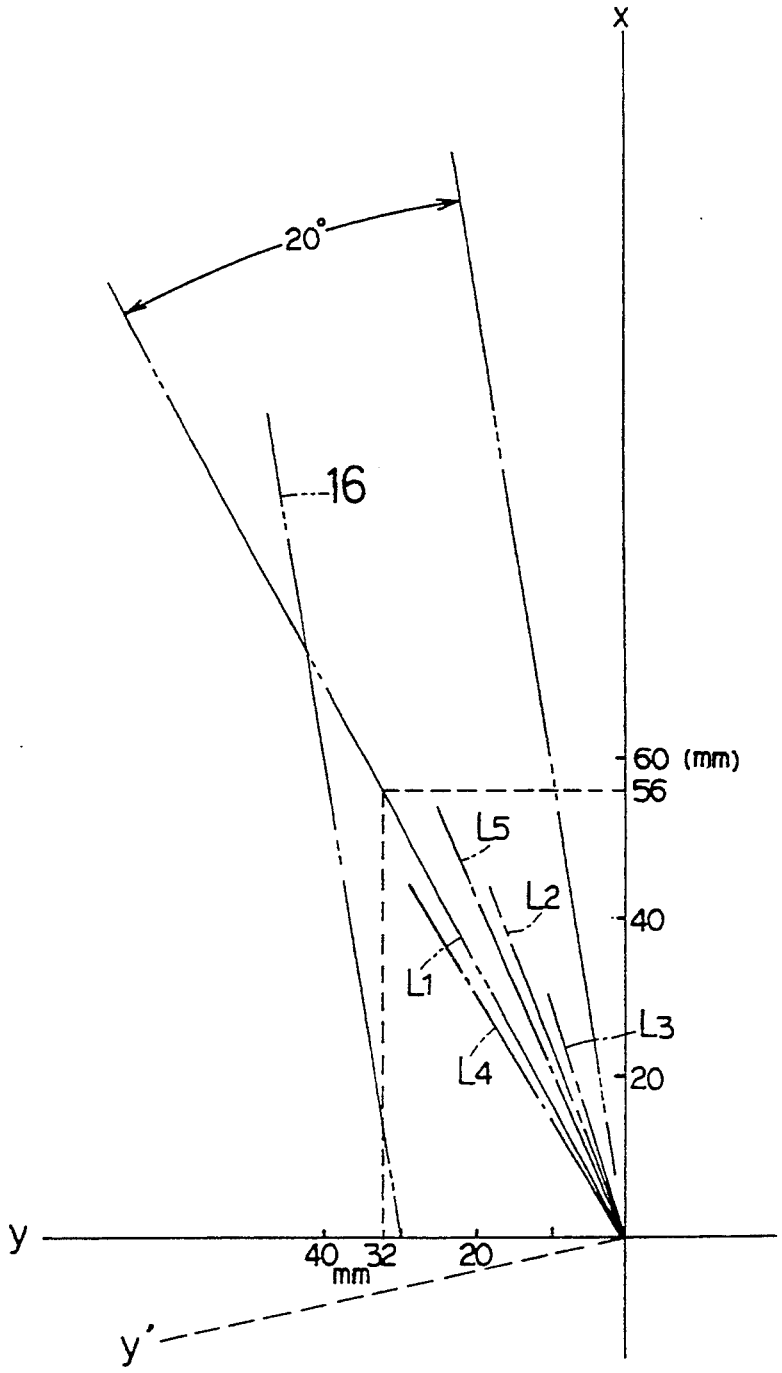
FIG. 4 is a graph showing experimental results for comparison between an experimental jaw crusher of the present invention and conventional comparative jaw crushers.

FIG. 4 is a graph showing experimental results for comparison between conventional comparative jaw crushers and an experimental jaw crusher of the present invention. In the graph, crescent motion performed by a specific point (R in FIG. 3) on the movable tooth plate 15 in each crusher between the lower and upper end points is approximately represented by a straight line. The axis of ordinates represents the vertical direction, and the axis of abscissas the horizontal direction. For reference to FIG. 3, a coordinate system (x', y') is entered in FIG. 4. Data on 5 different types of jaw crusher, which are different in parameters such as the amount of eccentricity, are shown by the lines $L_1$, $L_2$, $L_3$, $L_4$ and $L_5$.

The lines $L_2$ to $L_5$ show the conventional jaw crushers, respectively. The line $L_1$ shows an experiment in which the crusher has an eccentricity of 16 mm, and a relatively long stroke of motion, that is, 64 mm. In addition, the angle at which the tip of the movable tooth plate 15 goes toward the fixed tooth plate 16 is relatively large, that is, 20°. The line $L_2$ shows an experiment in which the stroke of motion is not so long (42 mm), and the angle at which the movable tooth plate 15 goes toward the fixed tooth plate 16 is relatively small (18.5°). The line $L_3$ shows an experiment in which the stroke of motion is short (30 mm), and the angle at which the movable tooth plate 15 goes toward the fixed tooth plate 16 is relatively small (18°). The line $L_4$ shows an experiment in which the stroke of motion is not so long (49.5 mm), but the angle at which the movable tooth plate 15 goes toward the fixed tooth plate 16 is considerably large (23°). The line $L_5$ shows an experiment in which the stroke of motion is considerably long (61 mm), but the angle at which the movable tooth plate 15 goes toward the fixed tooth plate 16 is relatively small (18.5°).

Figure 5:
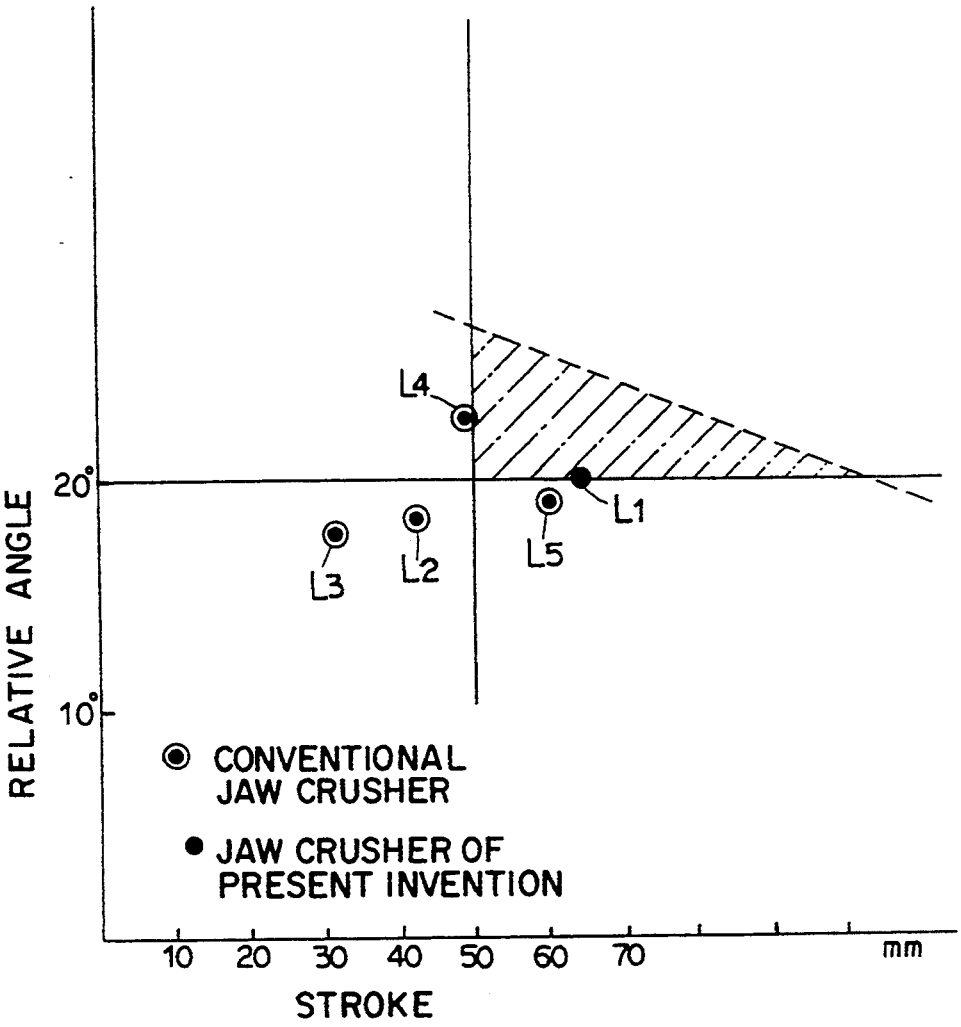
FIG. 5 is a graph showing data for comparison between the jaw crusher of the present invention and the conventional jaw crushers.

FIG. 5 is a graph showing the relationship between the relative angle (at which the end point of the movable tooth plate 15 goes toward the fixed tooth plate 16), which is plotted along the axis of ordinates, and the stroke (the linear distance between the lower and upper extremities of the motion of the end point on the movable tooth plate 15), which is plotted along the axis of abscissas, for each of the above 5 examples. The example of the present invention is within a region in which the stroke is not shorter than 50 mm and the relative angle is not smaller than 20°. However, the other 4 examples are not in this region (hereinafter referred to as "the region of the present invention").

According to-the experimental results, when a jaw crusher which is in a region other than the region of the present invention is used to crush asphalt, the asphalt is not broken into particles but undesirably mashed or caused to stick to the movable and fixed tooth plates 15 and 16, causing the machine to fall into an operation failure. In contrast, the experimental machine that is within the region of the present invention is capable of breaking asphalt into particles which can be reused as aggregates, in which substantially no stickiness is observed. It will be clearly understood from the experimental results of the 5 examples that when the relative angle is large, the asphalt crushing performance is good, and when the stroke is large, the crushing performance is also good; however, when only the relative angle or the stroke is large, the crushing performance is not good.

It has been found from the experimental results that the asphalt crushing performance is good when the following conditions (U1) are (U2) satisfied:

(U1) the relative angle between the straight line connecting the lower and upper end points of the approximately circular locus and the fixed tooth plate (16) is not smaller than 20°; and (U2) the distance between the lower and upper end points is not shorter than 50 mm.

This may be presumed as follows: Energy required for crushing is stored in asphalt by the motion (U1) of large relative angle. A rigid object can be crushed by this energy, but the crushing operation involves some unreasonableness. On the other hand, a non-rigid object can be crushed substantially reasonably. Next, the motion (U2) of large stroke exerts force on asphalt so that the fixed tooth plate side and the movable tooth plate side of the asphalt are largely displaced relative to each other. Presumably, asphalt is sheared by this force.

The validity of the above presumption has also been proved by an experiment carried out on relatively soft rocks (e.g., rocks which have been weathered). It should be noted that the upper limit of the stroke, the upper limit of the relative angle, and the correlation between these two upper limits are limited by design conditions such as the power of the prime mover used, the strength of the machine body, the size of the machine body, etc.

The present invention provides the following advantageous effect: A conventional jaw crusher can be used to crush a non-rigid object for the purpose of reusing it simply by changing parameters.

Although the present invention has been described through specific terms, it should be noted here that the described embodiment is not necessarily exclusive and that various changes and modifications may be imparted thereto without departing from the scope of the invention which is limited solely by the appended claim.

What is claimed is:

1. A jaw crusher for breaking a non-rigid object, said jaw crusher comprising:

a body (1);

a fixed tooth plate having a flat surface (16) secured to said body (1);

a swing jaw (8) adapted to swing relative to said fixed tooth plate (16);

a movable tooth plate (15) secured to said swing jaw (8) at an acute angle to said fixed tooth plate (16) to define a crushing space for breaking an object of crushing between said movable tooth plate (15) and said fixed tooth plate (16);

an eccentric rotating shaft (7) provided on said body (1) to swingably support an upper end portion of said swing jaw (8) and to rotate eccentrically; and a swing support member (10) provided between said body (1) and said swing jaw (8) so as to be swingable relative to both said body (1) and said swing jaw (8);

wherein motion of a lower end portion of said movable tooth plate (15) which is on an approximately circular locus satisfies the following conditions:

(U1) an angle between a surface of said fixed tooth plate (16) and a straight line connecting lower and upper end points of the approximately circular locus on which said lower end portion of said movable tooth plate (15) moves is not smaller than 20°; and (U2) the distance between said lower and upper end points is not shorter than 50 mm.

* * * * *